US010247394B2

(12) United States Patent
Bardot et al.

(10) Patent No.: US 10,247,394 B2
(45) Date of Patent: Apr. 2, 2019

(54) HOUSING FOR SECURING A RECESSED FIXTURE

(71) Applicant: PHILIPS LIGHTING HOLDING B.V., Eindhoven (NL)

(72) Inventors: Frederic George Bardot, Nivollet montgriffon (FR); Reinier Imre Anton Den Boer, Eindhoven (NL); Sébastien Thierry Fol, Jonage (FR)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 595 days.

(21) Appl. No.: 14/890,787

(22) PCT Filed: Apr. 24, 2014

(86) PCT No.: PCT/EP2014/058309
§ 371 (c)(1),
(2) Date: Nov. 12, 2015

(87) PCT Pub. No.: WO2014/183968
PCT Pub. Date: Nov. 20, 2014

(65) Prior Publication Data

US 2016/0091182 A1 Mar. 31, 2016

(30) Foreign Application Priority Data

May 14, 2013 (EP) ..... 13305608

(51) Int. Cl.
*F21S 8/02* (2006.01)
*F21V 21/04* (2006.01)

(52) U.S. Cl.
CPC ..... *F21V 21/047* (2013.01); *F21S 8/02* (2013.01); *F21V 21/044* (2013.01)

(58) Field of Classification Search
CPC ..... F21S 8/02; F21S 8/026; F21V 21/004; F21V 21/047; F21V 21/049
See application file for complete search history.

(56) References Cited

U.S. PATENT DOCUMENTS 4,733,339 A 3/1988 Kelsall
5,045,984 A 9/1991 Trowbridge et al.
(Continued)

FOREIGN PATENT DOCUMENTS

AU 2011226834 A1 10/2011
DE 102007036979 A1 11/2008
(Continued)

OTHER PUBLICATIONS

Machine Translation of JP S62 4018 (Omori).*
Machine Translation of DE 20 2009 016 736 (Erco).*

*Primary Examiner* — Robert J May
*Assistant Examiner* — Leah S MacChiarolo

(57) ABSTRACT

The current invention relates to a housing (10) for securing a recessed fixture in a support (20), the housing (10) comprising at least one spring (12) resting on a portion of the side wall (10*a*) when loaded, and extending outwardly from the side wall (10*a*) when released so as to secure the housing (10) in the support (20); the housing (10) further comprises at least one releasable retention member keeping the spring (12) loaded over a given length of insertion of the housing (10) into the support (20). The housing (10) can notably be used in a recessed light fixture.

9 Claims, 3 Drawing Sheets

(56) References Cited

U.S. PATENT DOCUMENTS

| | | | | |
|---|---|---|---|---|
| 5,077,650 | A | 12/1991 | Cestari | |
| 5,725,302 | A | 3/1998 | Sirkin | |
| 5,931,432 | A | 8/1999 | Herold et al. | |
| 5,941,625 | A | 8/1999 | Morand | |
| 8,308,322 | B2 | 11/2012 | Santiago et al. | |
| 2009/0135616 | A1 | 5/2009 | Caluori | |
| 2011/0180678 | A1 | 7/2011 | Liu | |
| 2011/0267826 | A1* | 11/2011 | Santiago | F21V 21/048 362/365 |
| 2017/0350582 | A1* | 12/2017 | Benghozi | F21V 25/12 |

FOREIGN PATENT DOCUMENTS

| | | | | |
|---|---|---|---|---|
| DE | 202009016736 | * | 2/2011 | F21S 8/02 |
| EP | 1016819 | A1 | 7/2000 | |
| EP | 1310730 | A1 | 5/2003 | |
| EP | 2314914 | A | 4/2011 | |
| GB | 2450986 | A | 1/2009 | |
| JP | 481930 | Y1 | 1/1973 | |
| JP | 624018 | U | 1/1987 | |
| JP | 11224527 | A | 8/1999 | |
| JP | 2001043725 | A | 2/2001 | |
| WO | WO2012091660 | A1 | 7/2012 | |

* cited by examiner

HOUSING FOR SECURING A RECESSED FIXTURE

CROSS-REFERENCE TO PRIOR APPLICATIONS

This application is the U.S. National Phase application under 35 U.S.C. § 371 of International Application No. PCT/EP2014/058309, filed on Apr. 24, 2014, which claims the benefit of or European Patent Application No. 13305608.5, filed on May 14, 2013. These applications are hereby incorporated by reference herein.

TECHNICAL FIELD

The current invention relates to a housing for securing a recessed fixture, for instance a recessed lighting fixture, notably in a structure such as a ceiling or wall, comprising a hole.

BACKGROUND

Recessed fixtures, notably recessed light fixtures, are commonly used in domestic and commercial premises. A recessed light fixture typically comprises a housing, usually essentially of cylindrical shape, receiving a light-emitting element such as for example an incandescent light bulb, or compact fluorescent light, or led emitting diode module. The housing is usually designed so as to be at least partially inserted in a support, such as a ceiling or a wall, through a hole. There are many different known electrical and electronic devices fixtures, using a variety of different technologies. For example, European patent published under the reference EP 1016819, discloses a fixture consisting of two legs fastened on a can housing in such a way that they can pivot around the fixing point on the housing. This housing has a flange which is able to lean on the outside surface of the support. The legs are held by springs so that they can put pressure on the inside surface of the support. The support is then maintained between the legs and the housing's flange.

Some other known fixtures have many fastening parts and springs so that when the housing can is inserted into the hole in the support, the fastening parts expand out of the housing to put pressure on the inside surface of the support. In order to accommodate with a variety of thicknesses of the support, such fixtures use systems like screws or clips which have to be manually operated by an operator, for example an installer.

It appears that an issue related to known fixtures lies in the fact that the installer has to manually move fastening parts, and to use his both hands for handling the fixture.

One of the main concerns for installing a recessed ceiling fixture is that the installer is often standing on a ladder, provided most supports for such fixtures are ceilings or high walls. Therefore the installer's safety is likely to be compromised if the installer has to use his/her both hands to install the fixture. Known methods for installing or removing fixtures such as those described hereinabove require the use of both hands.

Another issue during the installation of such fixtures is related to the installation time. Installation time directly correlates to the installation costs and usually derives from the high complexity of the installation.

Yet another issue with such fixtures is related to their height. Most fixtures use very high fastening parts in order to allow compensating for the many various thicknesses the support may have.

Yet another issue with such fixtures relates to removing the fixtures once they are in place, and possibly uninstalling then reinstalling them. The removing of such fixtures is indeed usually complicated because the installer has to loosen the screws or hold the fastening parts with his/her hands. Besides some fixtures are not designed so as to be reinstalled after removal, thus a mere displacement of such fixtures may become impossible.

SUMMARY

One aim of the present invention is to palliate at least the above mentioned drawbacks.

The present invention enables a quicker and easier installation and removal of a light fixture by an operator or installer using only one hand, and allows many reinstallations of the fixture, while requiring a much smaller built-in height, compared to known fixtures.

For that purpose, the current invention proposes a housing for securing a recessed fixture in a support, the housing comprising at least one spring resting on a portion of the side wall when loaded, and extending outwardly from the side wall when released so as to secure the housing in the support; the housing further comprises a releasable retention member keeping the spring loaded over a given length of insertion of the housing into the support.

The support typically comprises a hole, and the housing can comprise a side wall configured to be at least partly inserted through the hole, the housing further comprising at least one spring attached to the side wall, wherein the spring is configured for resting on a portion of the side wall when loaded, and for extending outwardly from the side wall when released so as to secure the housing in the support, the housing further comprising at least one retention member configured for keeping the spring loaded as long as the length of the side wall that has been inserted through the hole is smaller than a determined length, and for releasing the spring when the length of the side wall that has been inserted through the hole reaches the determined length.

In an exemplary embodiment of the invention, the side wall can be formed by a rim of essentially cylindrical shape, and the retention member can be formed by at least one sliding element configured for being slid substantially along the surface of the side wall as the housing is being inserted through the hole.

In an exemplary embodiment of the invention, each sliding element can be formed by a clip comprising a leg configured for leaning on a surface of the support as the housing is inserted through the hole.

In an exemplary embodiment of the invention, the housing can comprise a shoulder designed to rest on a surface of the support when the housing is fully inserted, and each leg can be configured to lean on the shoulder when the housing is fully inserted.

In an exemplary embodiment of the invention, each clip can comprise a horizontal groove configured for retaining one of said springs.

In an exemplary embodiment, the side wall can comprise a plurality of side wall sections separated by gaps, a gap being defined by the respective edges of two adjacent side wall sections, each clip being configured for sliding on two adjacent side wall sections.

In an exemplary embodiment, each clip can comprise a sliding member configured to be led along the corresponding edges of adjacent side wall sections forming leading surfaces.

In an exemplary embodiment, the sliding member can be formed by grooves in the lateral edges of the clip.

In an exemplary embodiment, each spring can have a shape designed to allow releasing the mounting through rotating the housing.

In an exemplary embodiment, each spring can be a beveled spring formed by an elongated blade having an essentially triangular shape, comprising at least one first end with a smaller height and one second end with a larger end, the housing comprising attachment means for attaching said second end to the side wall.

In an exemplary embodiment of the invention, the attachment means can be formed by spring attachment means on the surface of the side wall comprising grooves configured to be mated with corresponding notches realized on the springs in the region of said second end.

In an exemplary embodiment of the invention, the springs or the clips can be made of steel or of a plastic material.

Another aspect of the current invention is a recessed light fixture comprising a housing as per any of the described embodiments.

BRIEF DESCRIPTION OF THE DRAWINGS

These and other characteristics and advantages of the invention will be made clearer in view of the detailed description given below of a preferred embodiment, provided by way of an illustrative and non-limiting example only, as well as the accompanying drawings which represent.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Figure 1:
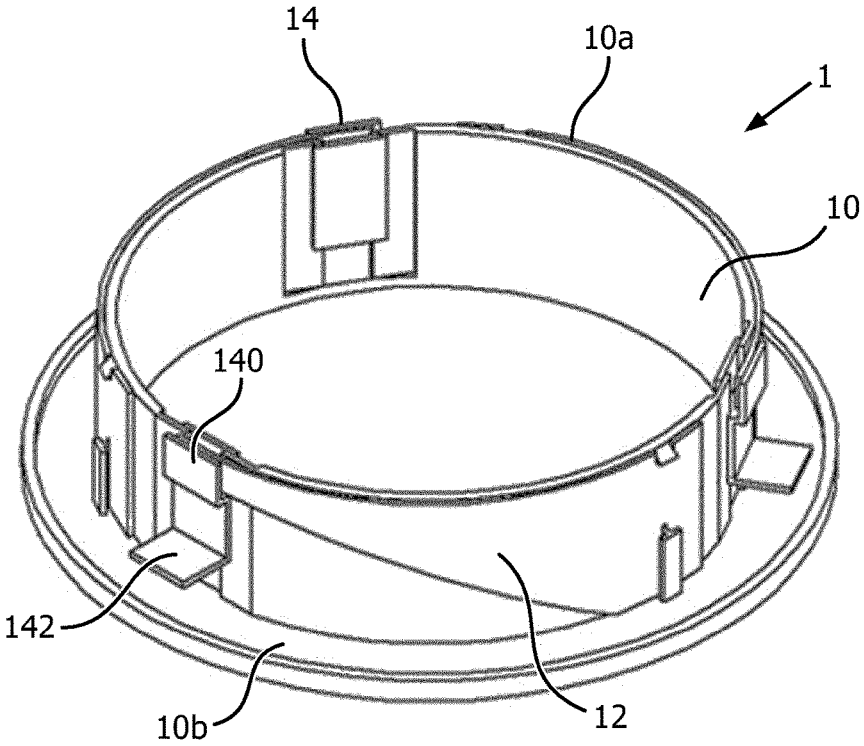
FIG. 1, a perspective view illustrating a housing following an exemplary embodiment of the invention.

FIG. 1 presents a perspective view illustrating a housing following an exemplary embodiment of the invention.

In the exemplary embodiment shown in FIG. 1, a housing 1 can have an overall shape similar to that of a typical housing comprised in a fixture for a lighting spot, to be installed in a ceiling for instance. The housing 1 has an essentially cylindrical shape, and can comprise a housing body 10 comprising a side wall 10*a* of cylindrical or conical shape, the housing body 10 having a lower base that can comprise a shoulder 10*b*, designed for resting on a support when the housing 1 is properly positioned therein, once fully inserted in the support through a hole. The housing 1 can further comprise connection members, such as a socket, for allowing attaching a light-emitting element, such as a light bulb, these elements being not illustrated in the figures.

As illustrated in FIG. 1, the side wall 10*a* can for example be formed by a rim with an essentially cylindrical shape.

According to a specificity of the present invention, a plurality of springs 12 can be attached to the side wall 10*a*, by means of adequate attachment means. Preferably, at least two springs can be used. In the non-limiting exemplary embodiments illustrated by the figures, three springs 12 are used. The springs 12 can have an elongated shape and can be designed so as to rest on the outer surface of the side wall 10*a* when they are loaded, by winding round the external surface of the side wall 10*a*, and further designed to extend radially outwardly from the outer surface of the side wall 10*a* when they are released.

The springs 12 can be manually loaded by an operator, and/or loaded during the assembly process of the housing 1. Each spring 12 can be kept loaded by means of a retention member 14. The retention member 14 can be formed by a sliding element, for example a clip 140. The housing can comprise as many clips 140 as there are springs 12. The clips 140 are designed to be able to be slid along the side wall 10*a* parallel to the side wall 10*a* main axis.

Figure 2A:
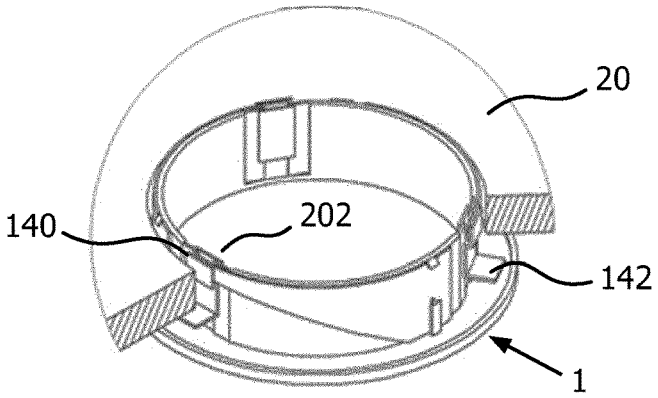
FIGS. 2A, 2B and 2C, perspective views illustrating a housing following an exemplary embodiment of the invention, at different phases during installation in a support.
Figure 2B:
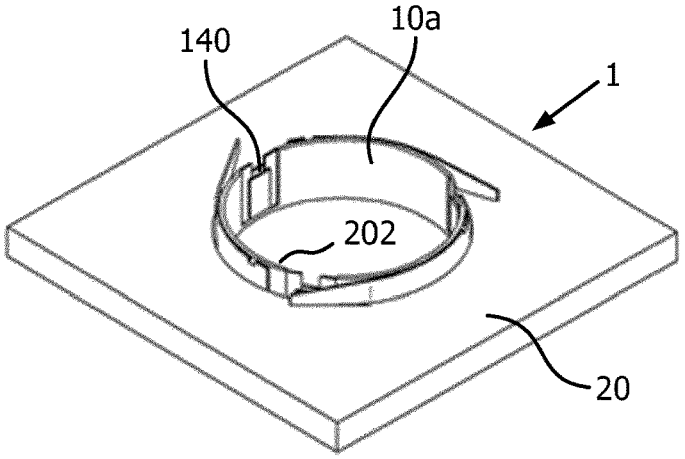
Figure 2C:
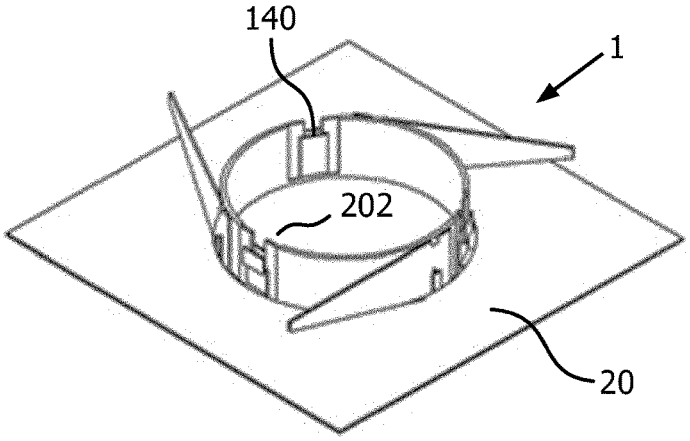

For example, each clip 140 can comprise a horizontal leg 142 configured in such a way that it can lean on the outside surface of the support when the fixture comprising the housing 1 is moved up inserted into the hole in the support, as illustrated in FIGS. 2A to 2C described hereinafter. As it is shown in the figures, a clip 140 can be designed so that its overall shape essentially moulds the shape of the external surface of the side wall 10*a*, while a horizontal leg 142 can be designed to essentially extend outwardly from the side wall 10*a*.

In place of a sliding element, the retention member 14 can be formed by a rotating element, for example designed to be rotated around an axis that is perpendicular to the main symmetry axis of the housing 1. The rotating element can comprise attachment means for being attached to the side wall 10*a* while being able to be rotated around the axis, thus forming a pivot linkage. The rotating element can have an essentially elongated shape, and can comprise at a first extremity a horizontal leg, configured in such a way that it can lean on the outside surface of the support when the fixture comprising the housing 1 is moved up inserted into the hole in the support, in a way similar to the leg 142 described above. The rotating element may possibly further comprise a second extremity having a shape that allows retaining the spring 12. For example; the leg can be protruding outwardly in reference to the external surface of the housing 1, and the shape of the second extremity can be designed to protrude inwardly in reference to the external surface of the housing 1. The rotation axis of the rotating element can preferably be located closer to the first extremity than to the second extremity of the rotating element, in order to increase the sensitivity of releasing the spring 12 thanks to the lever arm effect, the travel of the first extremity being thus smaller than that of the second extremity of the rotating element.

FIGS. 2A to 2C show perspective views illustrating a housing 1 as described below in reference to FIG. 1, at different phases during installation in a support 20, by insertion through a hole 202. In the exemplary embodiment shown in FIGS. 2A to 2C, the support 20 is a ceiling, only one part thereof being represented.

As shown in FIG. 2A, as the housing 1 is being inserted in the support 20 through the hole 202, it comes a moment when the legs 142 of the clips 140 get in touch with the outside surface of the support 20, that is: with the lower surface of a ceiling as in the example illustrated in FIGS. 2A to 2C, though the legs 142 cannot actually be seen in FIGS. 2B and 2C. At this moment, the springs 12 are kept resting on a portion of the side wall 10*a*, thanks to the retention members formed by the clips 140 in the illustrated example.

The shape of the springs 12, and the thickness thereof, can be configured in a way that the springs 12 do not protrude significantly when in retained configuration, so as not to hamper the insertion of the housing 1 through the hole 202. The hole 202 in the support 20 has a shape that is adapted to the shape of the housing 1, for example a round shape, and the hole 202 diameter is large enough for the clips 140 to be able to pass through, but smaller than the external diameter of the shoulder 10*b*, so as to prevent the fixture to entirely pass through the support 20, and smaller than the diameter around the legs 142 so that the legs 142 can lean on the outside surface of the support 20 when the fixture comprising the housing 1 is moved up inserted into the hole 202.

The housing 1 can be further designed so that the legs 142 lean on the upper surface of the shoulder 10*b*, once the housing 1 has been fully inserted in the support 20 through the hole 202.

Then, as the housing 1 is being inserted further into the support 20, the legs 142 keep resting on the outside surface of the support 20, and the clips 140 are slid down along the side wall 10*a* while the springs 12 are retained loaded by the clips 140, until a moment comes when the displacement of the clips 140 leads to the springs 12 being released outwardly from the side wall 10*a*, the springs 12 being then spreading above the inside surface of the support 20 and putting pressure on the inside surface, as illustrated in FIGS. 2B and 2C.

Stated differently, the springs 12 are configured for resting on a portion of the side wall 10*a* when loaded, and for extending outwardly from the side wall 10*a* when released so as to secure the housing 1 in the support 20, the retention members being configured for keeping the springs 12 loaded as long as the length of the side wall 10*a* that has been inserted through the hole 202 is smaller than a determined length, and for releasing the springs 12 when the length of the side wall 10*a* that has been inserted through the hole 202 reaches the determined length.

In an preferred embodiment, corresponding to the exemplary embodiments described in the figures, the springs 12 can be bevelled, for example by being formed with an elongated-shape triangular blade. One advantage brought by bevelled springs is that they allow compensating for various thicknesses of the support 20: however thick the support may be, a bevelled spring always allows that pressure be put on the internal side thereof, therefore keeping the fixture comprising the housing 1 properly positioned in its intended support. One other advantage brought by bevelled springs is that they allow easy removal of the housing 1, simply by rotating it clockwise or counter-clockwise, depending on the shape of the springs 12. Thus, an installer can easily remove a housing 1 comprising bevelled springs 12, simply using one hand for holding the shoulder 10*b* and rotating the housing 1 in the appropriate direction; if the housing 1 is part of a spot light fixture to be mounted in a ceiling, then it will drop down by itself due to its weight.

When the operator or installer wishes to reinstall the housing 1, he/she then has to load the springs 12 back again. To that end, the operator can lean the respective free ends of the springs 12 onto the outer surface of the side wall 10*a*, and move up the clips 140 until the springs 12 are retained by the clips 140. An example of a detailed structure of a clip 140 is described hereinafter in reference to FIG. 3B. Similarly, FIG. 3A presents a detailed structure of a housing body as in an exemplary embodiment of the invention, while FIG. 3C presents a detailed structure of springs, as in an exemplary embodiment of the invention.

Figure 3A:
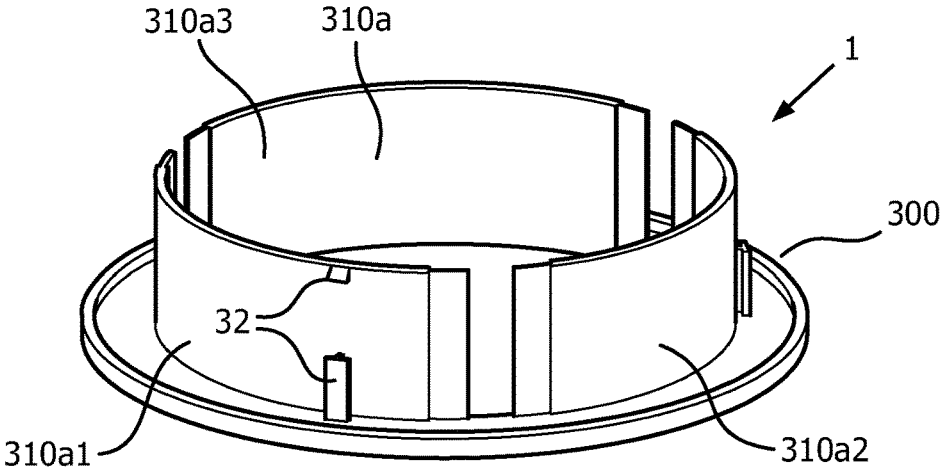
FIGS. 3A, 3B and 3C, perspective views illustrating the different components of a housing following an exemplary embodiment of the invention.

FIG. 3A illustrates a housing body of a housing as described below in reference to FIGS. 1 and 2A to 2C. A housing body 300 basically comprises a side wall 310*a*. In the exemplary embodiment illustrated by FIG. 3A, which is in no way limiting the current invention, the side wall 310*a* is formed by three side wall sections 310*a*1, 310*a*2, 310*a*3, separated by gaps. A gap is delimited by two respective edges of adjacent side wall sections 310*a*1, 310*a*2, 310*a*3, the edges of the adjacent side wall sections 310*a*1, 310*a*2, 310*a*3 being defining rails allowing sliding the sliding elements along the side wall 310*a*. A sliding element can be formed by a clip 140 as illustrated in FIG. 3B.

The side wall sections 310*a*1, 310*a*2, 310*a*3 can further comprise spring attachment means 32 allowing fastening the springs 12 to the housing, as described above. As in the exemplary embodiment illustrated in FIG. 3A, the spring attachments means 32 can be formed by protruding elements with a T-shaped section, thus providing grooves able to be mated with corresponding notches realized on the springs, as described hereinafter in reference to FIG. 3C. Various attachment means can also be used, such as rivets, clips, hooks, glue, soldering for example.

Figure 3B:
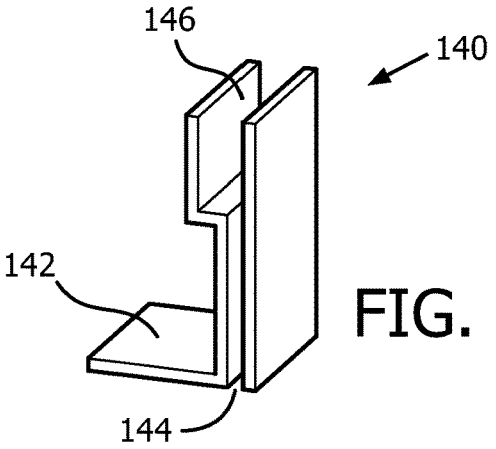
Figure 3C:
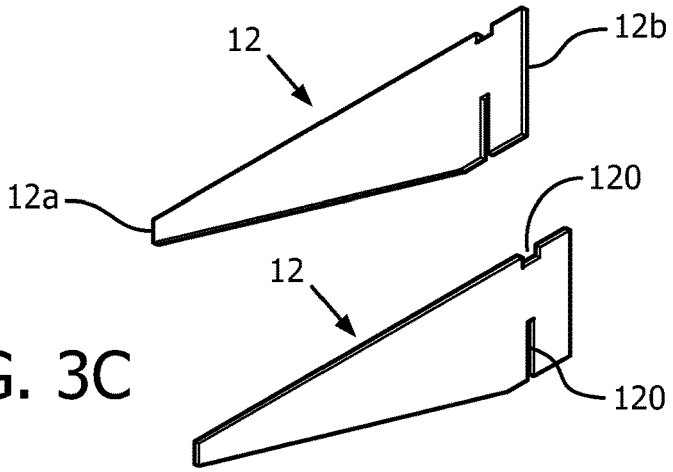

In reference to FIG. 3B, a clip 140 may essentially have the global shape of an "L", the basis of the clip 140 being forming the leg 142 as described above in reference to FIG. 1. The lateral edges, or vertical edges in the illustrated example, of the clip 140 can comprise a sliding member, for example formed by vertical grooves 144 that can be led along the leading surfaces that are formed by the edges of adjacent side wall sections 310*a*1, 310*a*2, 310*a*3 as defined above in reference to FIG. 3A. In a reciprocal manner, vertical grooves may be formed at the edges of adjacent side wall sections 310*a*1, 310*a*2, 310*a*3, in such a configuration the clip 140 may not comprise vertical grooves.

The clip 140 further comprises a horizontal groove 146, in its upper part, configured for retaining the springs 12.

In reference to FIG. 3C, the springs 12 can be formed with an elongated-shape triangular blade according to a preferred embodiment as described above, i.e. having at least one first end 12*a* with a smaller height designed for allowing retaining the springs 12, for instance by resting in the horizontal groove 146, and one second end 12*b* with a larger height. The second end 12*b* can possibly comprise notches 120, for allowing fastening the spring 12 to attachment means 32 comprised in the housing body 300, as described above in reference to FIG. 3A.

The springs 12, as well as the clips 140 and housing body 300, can for instance be made of steel; they can also be made of a plastic material.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For example, the illustrated embodiments relate to fixtures for lighting spots, in a support such as a ceiling. Similar structures may for instance also apply to wall fixtures for electrical switches or mains sockets.

All definitions, as defined and used herein, should be understood to control over dictionary definitions, definitions in documents incorporated by reference, and/or ordinary meanings of the defined terms.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed at limiting the scope.

The invention claimed is:

1. Housing for securing a recessed fixture in a support comprising a hole, the housing comprising:

a side wall configured to be at least partly inserted through the hole, at least one spring attached to the side wall, wherein the spring is configured for resting, winding around on a portion of the side wall when loaded, and for extending outwardly from the side wall when released so as to secure the housing in the support, the housing further comprising a retention member for keeping the spring loaded as long as a length of the side wall that has been inserted through the hole is smaller than a determined length, and for releasing the spring when the length of the side wall that has been inserted through the hole reaches the determined length;

and wherein the side wall is formed by a rim of essentially cylindrical shape, said retention member being formed by at least one sliding element configured for being slid along the surface of the side wall parallel to the side wall main axis as the housing is being inserted through the hole;

wherein each sliding element is formed by a clip comprising a leg configured for leaning on a surface of the support as the housing is inserted through the hole; and wherein the side wall comprises a plurality of side wall sections separated by gaps, a gap being defined by the respective edges of two adjacent side wall sections, each clip being configured for sliding on two adjacent side wall sections.

2. The housing as claimed in claim 1, comprising a shoulder designed to rest on a surface of the support when the housing is fully inserted, and wherein each leg is configured to lean on the shoulder when the housing is fully inserted.

3. The housing as claimed in claim 2, wherein the clip comprises a horizontal groove configured for retaining one of said springs.

4. The housing as claimed in claim 1, wherein each clip comprises a sliding member configured to be led along the corresponding edges of adjacent side, wall sections, forming leading surfaces.

5. The housing as claimed in claim 4, wherein said sliding member is formed by grooves in the lateral edges of the clip.

6. The housing as claimed in claim 1, wherein said springs are made of steel.

7. The housing as claimed in claim 1, wherein said springs are made of a plastic material.

8. A recessed light fixture comprising a housing as claimed in claim 1.

9. Housing for securing a recessed fixture in a support comprising a hole, the housing comprising:

a side wall configured to be at least partly inserted through the hole, at least one spring attached to the side wall, wherein the spring is configured for resting, winding around on a portion of the side wall when loaded, and for extending outwardly from the side wall when released so as to secure the housing in the support, the housing further comprising a retention member for keeping the spring loaded as long as a length of the side wall that has been inserted through the hole is smaller than a determined length, and for releasing the spring when the length of the side wall that has been inserted through the hole reaches the determined length;

and wherein the side wall is formed by a rim of essentially cylindrical shape, said retention member being formed by at least one sliding element configured for being slid along the surface of the side wall parallel to the side wall main axis as the housing is being inserted through the hole;

wherein each spring has a shape designed to allow releasing the mounting through rotating the housing;

wherein each spring is a bevelled spring formed by an elongated blade having an essentially triangular shape, comprising at least one first end with a smaller height and one second end with a larger end, the housing comprising attachment means for attaching said second end to the side wall; and wherein said attachment means are formed by spring attachment means on the surface of the side wall comprising grooves configured to be mated with corresponding notches realized on the springs in the region of said second end.

* * * * *